US008510905B2

(12) United States Patent
Boos et al.

(10) Patent No.: US 8,510,905 B2
(45) Date of Patent: Aug. 20, 2013

(54) VACUUM DEBRIS COLLECTION BOX HAVING SLOPED DEBRIS CHUTE

(75) Inventors: Scott F. Boos, Tampa, FL (US); Ian Ellman Brown, Valrico, FL (US)

(73) Assignee: Blasters Technologies, LLC, Tampa, FL (US)

( * ) Notice: Subject to any disclaimer, the term of this patent is extended or adjusted under 35 U.S.C. 154(b) by 265 days.

(21) Appl. No.: 12/842,533

(22) Filed: Jul. 23, 2010

(65) Prior Publication Data

US 2012/0017390 A1 Jan. 26, 2012

(51) Int. Cl.
*A47L 9/00* (2006.01)

(52) U.S. Cl.
USPC ..... 15/340.1; 15/347

(58) Field of Classification Search
USPC ..... 15/302, 320, 321, 340.1, 347
See application file for complete search history.

(56) References Cited

U.S. PATENT DOCUMENTS 4,218,226 A * 8/1980 Boozer ..... 96/414
6,029,430 A * 2/2000 Isfort et al. ..... 56/12.8
2006/0078384 A1 4/2006 Jacob et al.
2006/0185689 A1* 8/2006 Crocker ..... 134/10
2009/0241999 A1 10/2009 Crocker
2010/0000977 A1* 1/2010 Sudhakar ..... 219/121.69

OTHER PUBLICATIONS

International Search Report with a mailing date of Mar. 20, 2012 for corresponding international patent application No. PCT/US2011/045142 with an international filed of Jul. 25, 2011.
International Preliminary Report on Patentability with a mailing date of Jan. 31, 2013 for corresponding International Patent Application No. PCT/US2011/045142.

* cited by examiner

*Primary Examiner* — Robert Scruggs
(74) *Attorney, Agent, or Firm* — Ronald E. Smith; Smith & Hopen, P.A.

(57) ABSTRACT

A vacuum box in fluid communication with a tractor that removes coatings from surfaces. The vacuum box includes a vacuum inlet in fluid communication with a source of negative pressure and a debris inlet in fluid communication with the tractor so that debris is drawn into and collected within a hollow interior of the vacuum box. A water outlet provides a drain for water that collects within the vacuum box. A sloped false bottom wall is disposed within the hollow interior so that debris collects atop it. The vacuum box is emptied by draining water from it, followed by opening a door formed in the vacuum box at the lower end of the sloped false bottom wall so that the collected debris slides down the false bottom wall and out the door into a debris receptacle.

7 Claims, 7 Drawing Sheets

VACUUM DEBRIS COLLECTION BOX HAVING SLOPED DEBRIS CHUTE

BACKGROUND OF THE INVENTION

1. Field of the Invention

This invention relates to a vacuum box that collects debris created by a tractor and discharges the debris through a chute.

2. Description of the Prior Art

Vacuum boxes are used to collect water, pulverized asphalt, paint, rubber, thermoplastic, tape, and curing compounds and other debris created when high pressure water is discharged by a nozzle bar mounted on a tractor to remove pavement markings or coatings from roads, airport runways, taxiways, parking lots, and the like. A vacuum is maintained in the box to pull such debris from the water-blasted surface into the hollow interior of the vacuum box.

Problems arise when the typical vacuum box is full or substantially full. The weight of a full vacuum box can be substantial so emptying it can be difficult. The conventional emptying method uses an integral tilting cylinder to lift and tilt the vacuum box to discharge its contents. Such elevation of the center of gravity creates a stability hazard and can result in a rollover of the vacuum box.

Thus there is a need for a vacuum box that can be emptied without being inverted, tilted, or pivoted, thereby eliminating stability hazards.

However, in view of the prior art considered as a whole at the time the present invention was made, it was not obvious to those of ordinary skill in the art that a better vacuum box was needed nor was it obvious how a conventional vacuum box could be improved.

SUMMARY OF THE INVENTION

The long-standing but heretofore unfulfilled need for an improved vacuum box is now met by a new, useful, and non-obvious invention.

The inventive structure is used with a tractor of the type used to remove pavement markings or coatings from asphalt or concrete roads, parking lots and the like by blasting the asphalt or concrete with water under high pressure. The technology is also used in removing pavement markings or coatings and built up runway rubber from airport runways and taxiways as indicated at airport-technology.com.

A vacuum is created in the novel vacuum box by a conventional vacuum pump or other suitable means so that debris removed by the tractor is drawn from the water-blasted surface into the hollow interior of the vacuum box.

A first end of a debris-collection hose is in open communication with at least one water discharge nozzle and a second end of said hose is connected to a debris inlet that is in open communication with the interior of the vacuum box. The debris includes water, aggregate and the specific pulverized coating that is being removed by the high pressure water. The debris settles to the bottom of the vacuum box and is stored for later discharge.

The vacuum box or tank includes a sloped floor or false bottom wall that is elevated at the front of the box and substantially co-planar with a level bottom wall of the tank at the rear of the tank. A hingedly mounted, normally closed door is mounted to a bottom edge of the back wall of the tank. To discharge the debris, the water is decanted and the door is opened so that the debris slides down the sloped false bottom wall and out the door into a collection receptacle or disposal location.

The angle of the sloped false bottom wall is greater than an angle of repose so that debris that collects atop it will slide downwardly and out the door when the door is open. The angle of repose is that angle at which the debris will not slide when the door is open and depends upon multiple factors including the coefficient of friction of the sloped false bottom wall. In a preferred embodiment, the coefficient of friction is minimized by applying a material having a very low coefficient of friction in overlying relation to the sloped false bottom wall. This reduces the angle of repose and hence the angle of the sloped false bottom wall that is only slightly greater than said angle of repose, thereby maximizing the interior collection volumes of the vacuum box or tank.

More particularly, the novel vacuum box includes a generally cubical structure formed by a top wall, a bottom wall, a back wall, a front wall, a left side wall and a right side wall that are sealingly engaged to one another to collectively form a structure having a hollow interior that can hold debris and water while maintaining a vacuum.

A vacuum inlet is mounted to a preselected wall of the cubical structure. It is mounted to the top wall in the preferred embodiment. It has an open configuration and a closed configuration, and is adapted to be in fluid communication with a remote source of negative pressure so that a vacuum is maintained within the hollow interior when the vacuum inlet is in its open configuration.

The debris inlet is preferably mounted to the upper portion of the back wall of the structure has an open configuration and a closed configuration, and is adapted to be in selective fluid communication with the debris-collection hose so that debris enters into the hollow interior of the vacuum box when the vacuum inlet and the debris inlet are in their respective open configurations.

At least one drainage nipple forms a part of the cubical structure and also has an open configuration and a closed configuration. It provides a drain so that water in the hollow interior is drained therefrom when the drain is in its open configuration. This substantially lightens the vacuum box prior to complete emptying thereof and substantially separates the water from the solids prior to said complete emptying.

The sloped false bottom wall is disposed within the hollow interior of the vacuum box at a downward angle of about thirty degrees (30°) relative to a horizontal plane. The sloped false bottom wall has a rearward, elevated end attached to the front wall in vertically spaced, upward relation to the bottom wall and has a forward, lower end attached to a forward end of the horizontal bottom wall.

The forward wall has a vertical extent less than a vertical extent of the left and right side walls, thereby creating an opening between a lower end of the forward wall and the forward end of the sloped false bottom wall.

A door is mounted in closing relation to the opening and has an open configuration and a closed configuration. The door is in the closed configuration when the tractor is in operation. Debris slides down the sloped false bottom wall and out of the hollow interior of the vacuum box when the door is in its open configuration.

An important object of the invention is to provide a vacuum box that is easy to empty without safety hazards.

A more specific object is to provide a vacuum box that is not lifted or tilted when discharging.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
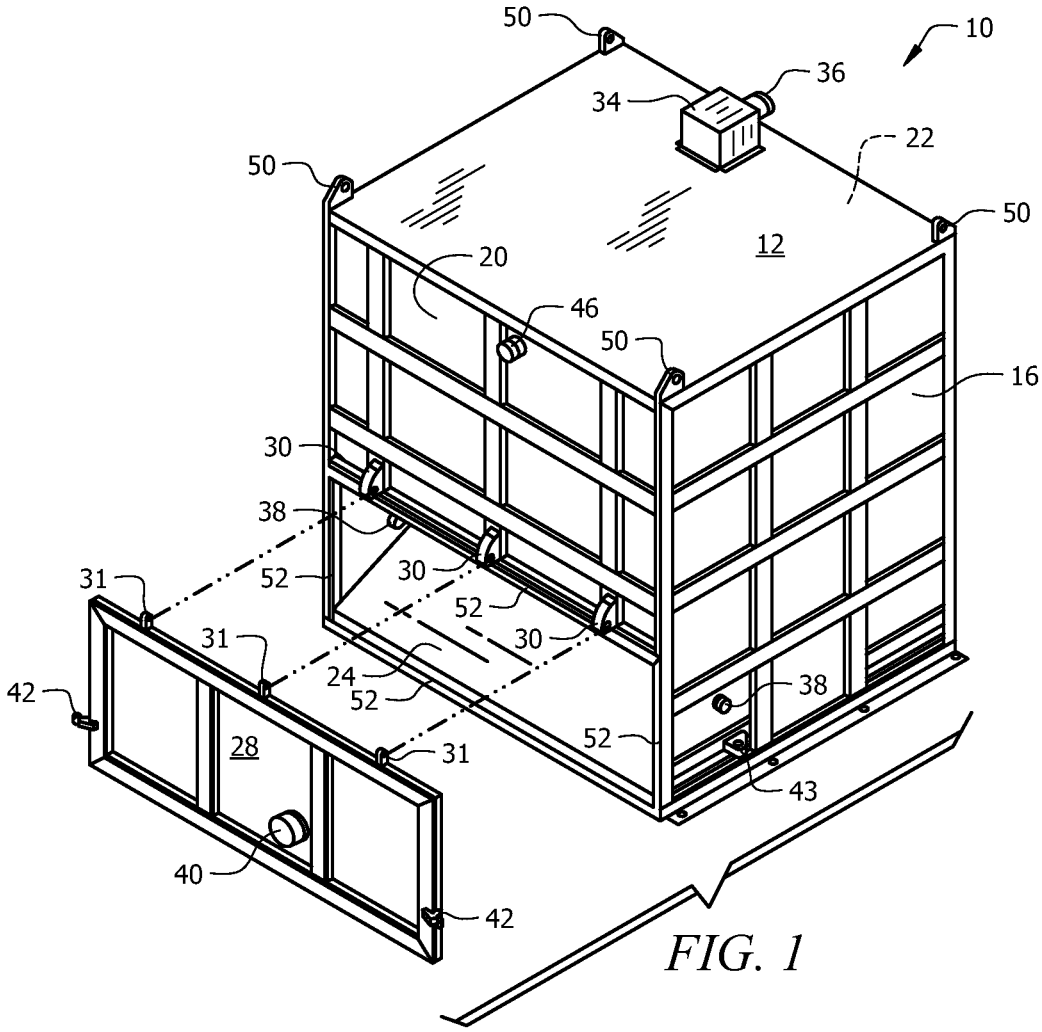
FIG. 1 is an exploded perspective view of the novel vacuum box and the front rear door.
Figure 2:
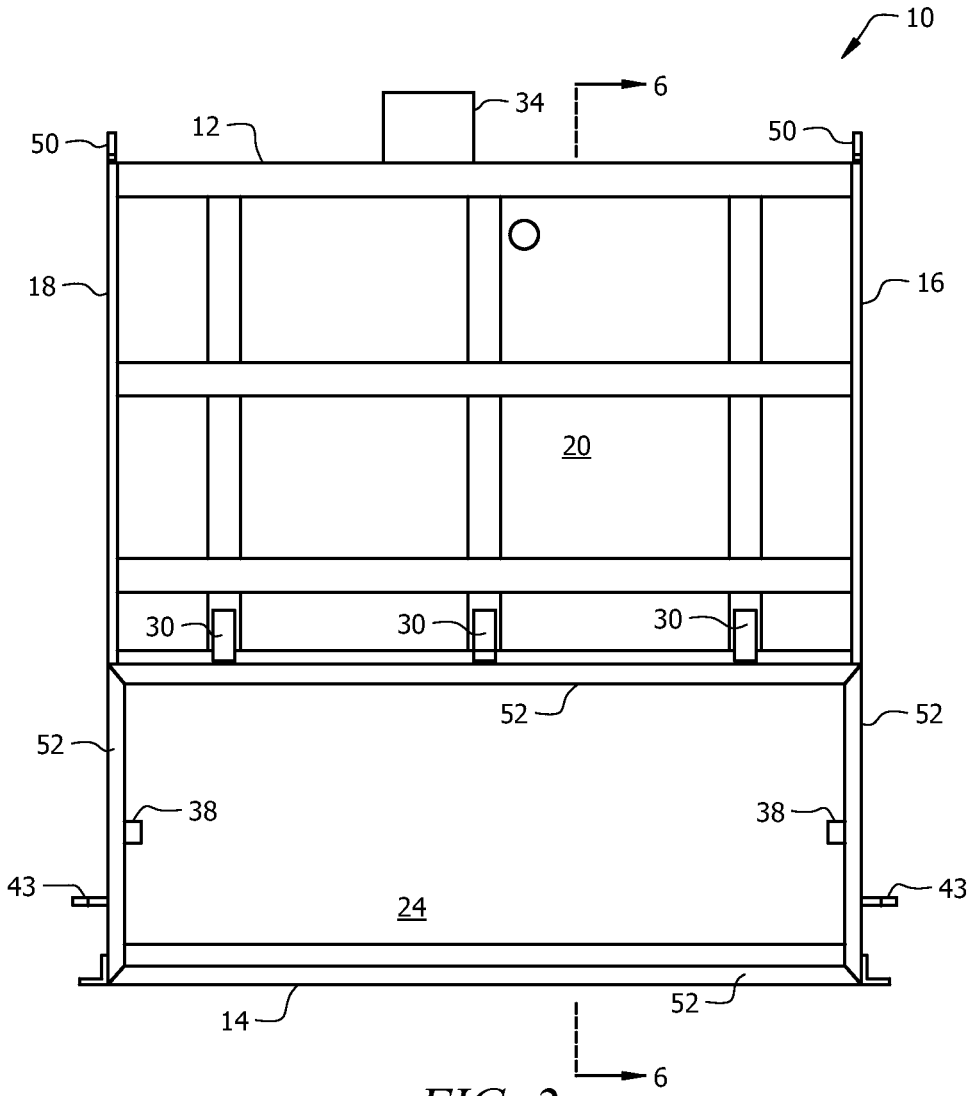
FIG. 2 is a rear elevational view of the box depicted in FIG. 1 with the door removed.

Referring now to FIGS. 1 and 2, it will there be seen that the novel vacuum box is denoted as a whole by the reference numeral 10.

Vacuum box 10 has a generally cubic shape, having six (6) exterior walls and a sloped interior wall that provides a false bottom. More particularly, the structure includes top and bottom walls 12, 14, left and right sidewalls 16, 18, back and front walls 20, 22, and sloped false bottom wall 24.

Each wall is a steel plate reinforced by a plurality of equidistantly spaced apart horizontally disposed tubular support members and a plurality of equidistantly spaced apart vertically disposed tubular support members that collectively form a grid pattern as depicted. The horizontal and vertical tubular support members are unnumbered to avoid cluttering the drawings. The horizontal and vertical tubular support members are secured to the exterior surfaces of the front and back walls and the left and right side walls but are secured to the interior surfaces of the top and bottom walls in the preferred embodiment.

This particular grid pattern of tubular support members, which serve as braces to prevent implosion of box 10 when under vacuum, is not critical to the invention. No braces are needed if the steel walls, or walls formed of any other suitable material, are sufficiently thick to not require bracing.

The top end of back wall 20 is coplanar with top wall 12 but the lower end of back wall 20 is vertically spaced from the plane of bottom wall 14, thereby creating a rectangular opening that is closed by door 28. Door 28 is depicted in exploded view in FIG. 1 and is not depicted in FIG. 2.

A plurality of hinge brackets, collectively denoted 30, is mounted to respective lower ends of the vertical tubular support members that brace back wall 20. Mating brackets 31 are secured to the upper end of door 28 and suitable hinge pins interconnect associated hinge brackets to one another. Door 28 is opened manually, hydraulically, or by other suitable means.

Debris enters the hollow interior of box 10 through debris inlet nipple 46 which is preferably mounted on back wall 20 near the upper end thereof as depicted in FIG. 1. Said nipple 46 provides a mount for a debris-carrying hose, not depicted, that extends from a pavement marking removal tractor, denoted in FIG. 7 by the reference numeral 11. However, the invention is not limited to use with a pavement marking removal tractor. It can be used with vehicles other than tractors and it can also be used in applications where no vehicles are involved, i.e., the invention is novel box 10, and not the equipment with which it may be used or the application to which it may be applied. Similarly, vacuum nipple 36 provides a mount for a hose, not depicted, that extends from said nipple 36 to a remote vacuum source, not depicted. Vacuum nipple 36 is in open fluid communication with vacuum housing 34 and said vacuum housing 34 is mounted on top wall 12 and is in open fluid communication with the interior of vacuum box 10.

It is important to get a good separation of water and debris before water is drained from the box. Drain nipples 38, 38 are therefore respectively positioned in sidewalls 16 and 18 or any other wall at any height. Both drain nipples extend through their respective sidewalls as best understood by comparing FIGS. 1 and 2. The respective external ends thereof are blocked from view in FIG. 2 by peripheral frame 52 that accommodates a sealing lip of door 28.

Pipe nipple 40 is a larger nipple, having a diameter of about six inches (6"). It extends through door 28 to drain water that may remain after both drain nipples 38, 38 have been opened and before door 28 is opened.

Clamp arms 42, 42 are fixedly secured to opposite ends of door 28 as depicted. Each clamp arm 42 is engaged to an associated side wall-mounted bracket 43 by a ratchet clamp, lever or cylinder, and mid door clamp, not depicted, to secure door 28 in its closed and sealed position.

Figure 3:
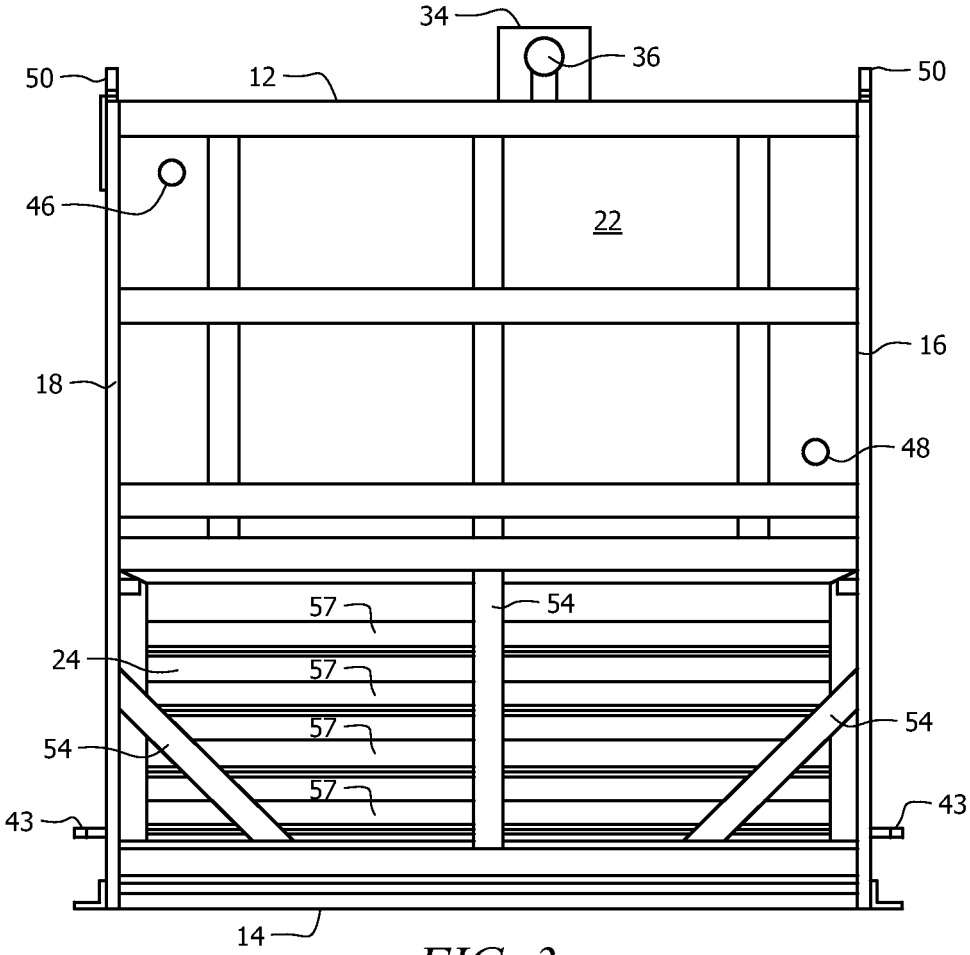
FIG. 3 is a front elevational view of said box.

Nipples 46, 48 formed in front wall 22, depicted in FIG. 3, provide secondary inlet and decant connections. Opening 46 is a secondary inlet and opening 48 is a secondary decant.

Brackets 50 are secured to top wall 12 and are engaged by lifting hooks when box 10 is lifted for installation or removal.

Seal channel 52 (FIG. 2) is a recess containing a compressible seal, not depicted. A raised mating ridge is formed about the periphery of door 28 to maintain the vacuum when box 10 is in use.

As depicted in the rear elevational view of FIG. 3, front wall 22 need not extend from top wall 12 to bottom wall 14 due to the presence of sloped false bottom wall 24. The lower end of front wall 22 is in registration with the elevated end of sloped false bottom wall 24. Support tubes, collectively denoted 57, are mounted transversely to the underside of sloped false bottom wall 24 to structurally reinforce said sloped false bottom wall, i.e., said support tubes aid in carrying the load of the water and debris within the tank.

Braces, collectively denoted 54, provide additional support for side walls 16, 18 to maintain the structural integrity of box 10 when it is under vacuum and when not under vacuum but filled with water and debris.

In the alternative, front wall 22 could extend from top wall 12 to sloped false bottom wall 24 and the grid pattern of the horizontal and vertical support tubes, or any other suitable bracing means, if needed, as mentioned above, could brace the entirety of said full front wall. The front wall is extended in the preferred embodiment only to the highest level of sloped false bottom wall 24 to save materials and to lighten vacuum box 10.

Figure 4:
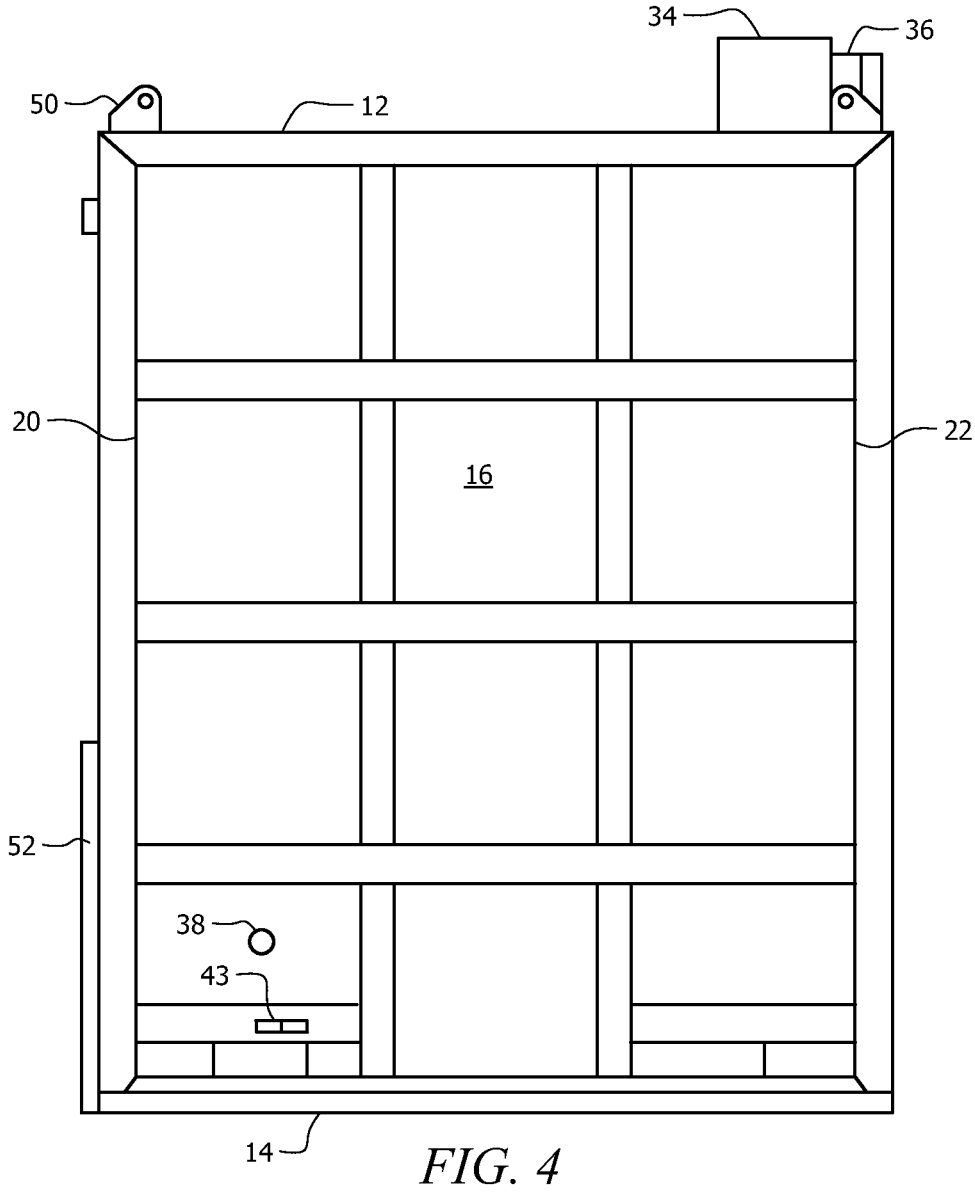
FIG. 4 is a side elevational view thereof.
Figure 5:
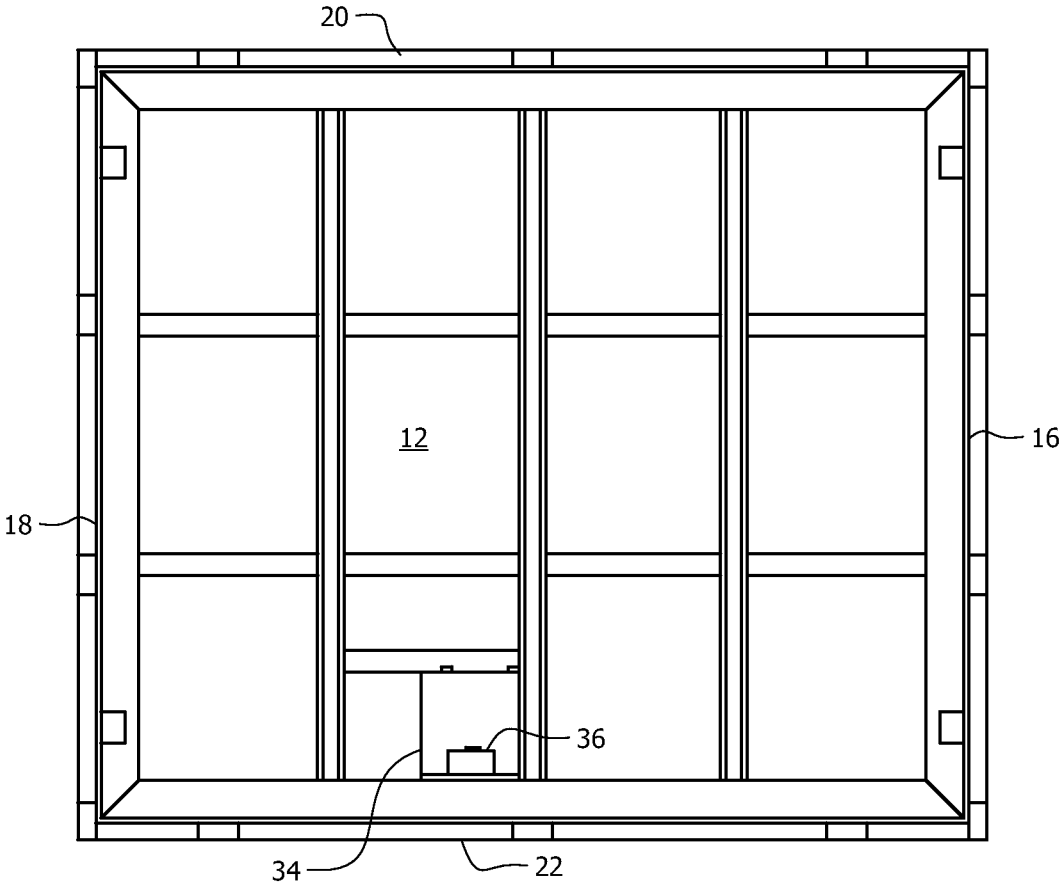
FIG. 5 is a plan view of the interior side of the top wall.
Figure 6:
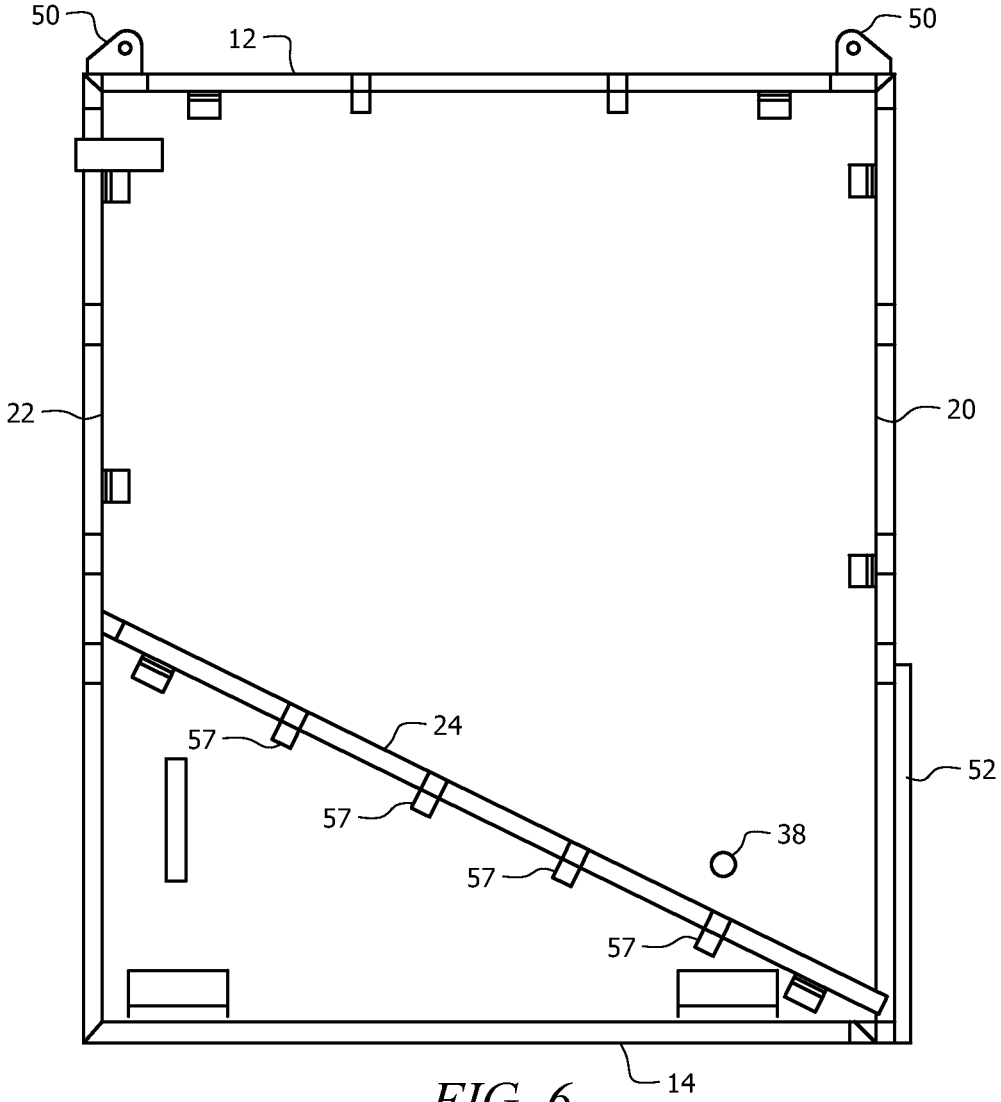
FIG. 6 is a sectional view taken along line 6-6 in FIG. 2.

All of the parts depicted in FIGS. 4-6 have already been disclosed.

Figure 7:
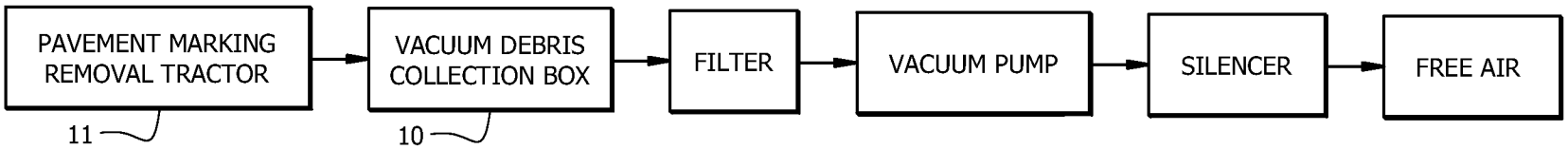
FIG. 7 is a process diagram depicting the novel vacuum box in the context of its related parts.

FIG. 7 is a process diagram showing the position of novel vacuum box 10 relative to pavement marking removal tractor 11, the vacuum pump that provides the vacuum, the filter through which air flows from novel vacuum box 10 into said vacuum pump, the silencer for the vacuum pump, and the ambient environment.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A vacuum box adapted to be in fluid communication with water and debris generated by a device that generates water and debris, comprising:

a generally cubical structure including a top wall, a bottom wall, a front wall, a back wall, a left side wall and a right side wall that are engaged to one another to form a structure having a hollow interior;

a vacuum inlet mounted to said cubical structure, said vacuum inlet having an open configuration and a closed configuration, and said vacuum inlet adapted to be in fluid communication with a source of negative pressure so that a vacuum is maintained within said hollow interior when said vacuum inlet is in said open configuration;

a debris inlet forming a part of said cubical structure, said debris inlet having an open configuration and a closed configuration, and said debris inlet adapted to be in fluid communication with said device so that water and debris enter into said hollow interior when said vacuum inlet and said debris inlet are in their respective open configurations;

a sloped false bottom wall disposed within said hollow interior;

said sloped false bottom wall having a forward, elevated end attached to said front wall in vertically spaced, upward relation to said bottom wall and having a rearward, lower end attached to a rearward end of said bottom wall;

an opening between a lower edge of said rearward wall and said rearward edge of said sloped false bottom wall;

a door mounted in closing relation to said opening, said door having an open configuration and a closed configuration;

said door being in said closed configuration when said device is in operation; and said door being in said open configuration so that debris can slide down said sloped false bottom wall and out of the hollow interior of said vacuum box when said door is in said open configuration.

2. The vacuum box of claim 1, further comprising:

at least one drainage nipple formed in a preselected wall of said vacuum box, said at least one drainage nipple having an open configuration and a closed configuration;

said at least one drainage nipple being in said closed configuration when said device is in operation;

said at least one drainage nipple being in said open configuration when said device is not in operation and said door is closed so that water can drain from said hollow interior through said at least one drainage nipple prior to opening of said door.

3. The vacuum box of claim 1, further comprising:

at least one drainage nipple formed in said door and said at least one drainage nipple having an open configuration and a closed configuration;

said at least one drainage nipple being in said closed configuration when said device is in operation;

said at least one drainage nipple being in said open configuration when said device is not in operation and said door is closed so that water can drain from said hollow interior through said at least one drainage nipple prior to opening of said door.

4. The vacuum box of claim 1, further comprising:

an auxiliary debris inlet formed in said front wall, said auxiliary debris inlet having an open configuration and a closed configuration;

an elongate hose connecting said auxiliary debris inlet to said device;

said auxiliary debris inlet being in said open configuration when said device is in operation and said door is closed so that debris generated by operation of said device enters into said hollow interior of said vacuum box through said debris inlet and said auxiliary debris inlet.

5. The vacuum box of claim 1, further comprising:

said sloped false bottom wall being sloped at an angle of about thirty degrees) (30°).

6. The vacuum box of claim 1, further comprising:

said sloped false bottom wall being sloped at an angle slightly greater than an angle of repose, said angle of repose being an angle at which debris collected atop said sloped false bottom wall is held against sliding by frictional forces;

said sloped floor being greater than said angle of repose allowing debris to discharge and slide out without additional input from an operator performing a discharging operation.

7. The vacuum box of claim 1, further comprising:

said front wall having a vertical extent less than a vertical extent of said left and right side walls.

* * * * *